United States Patent [19]

Brooks et al.

[11] Patent Number: 4,581,910

[45] Date of Patent: Apr. 15, 1986

[54] PUZZLE KEY HOLDER

[76] Inventors: Paul Brooks, 2701 Edwin Pl., Los Angeles, Calif. 90046; John P. Brooks, 2112 Outpost Dr., Los Angeles, Calif. 90068

[21] Appl. No.: 586,300

[22] Filed: Mar. 5, 1984

[51] Int. Cl.[4] ..... A44B 15/00; A47G 23/10; A41F 1/00

[52] U.S. Cl. ..... 70/456 R; 24/575; 24/3 K; 70/457

[58] Field of Search ..... 70/456 R, 459, 456 B, 70/457, 458; 24/575, 576, 577, 590, 3 K

[56] References Cited

U.S. PATENT DOCUMENTS

| | | | |
|---|---|---|---|
| 2,432,870 | 12/1947 | Evalt | 24/3 K |
| 2,533,799 | 12/1950 | Haydu | 24/573 |
| 2,558,367 | 6/1951 | Madsen | 24/576 |
| 2,564,918 | 8/1951 | Old | 70/456 R |
| 2,615,227 | 10/1952 | Hornik | 70/457 |
| 2,840,878 | 7/1958 | Olson | 70/457 |
| 3,327,362 | 6/1967 | Bousquet | 24/575 |
| 3,520,033 | 7/1970 | Usuda | 24/575 |
| 3,600,917 | 8/1971 | Krock | 70/457 |
| 3,979,934 | 9/1976 | Isenmann | 70/459 |
| 4,052,774 | 10/1977 | Noda | 24/575 |

FOREIGN PATENT DOCUMENTS

| | | | |
|---|---|---|---|
| 1026725 | 4/1953 | France | 24/576 |
| 26631 | of 1898 | United Kingdom | 24/575 |

*Primary Examiner*—Kenneth J. Dorner
*Assistant Examiner*—Vinh Luong
*Attorney, Agent, or Firm*—Fulwider, Patton, Rieber, Lee & Utecht

[57] ABSTRACT

A puzzle key holder for use with two key rings. The holder includes a main body and an auxiliary body, each of which receives a key ring. Complementary sockets and pins are formed in the abutting edges of the bodies to normally retain such bodies as an integral member. The bodies are relatively moveable relative to one another so as to become disengaged from one another. Such disengagement can only be effected by person's having knowledge of the relative motions necessary to effect such disengagement.

4 Claims, 7 Drawing Figures

PUZZLE KEY HOLDER

BACKGROUND OF THE INVENTION

Two-part key holders for use with two key rings, as for example, on holding car keys and the other holding house keys, are well-known. The two parts of the holders may be separated to permit the car keys to remain in the car for use by a parking lot attendant, with the driver retaining the house keys.

BRIEF SUMMARY OF THE INVENTION

It is a major object of the present invention to provide a two-part separable key holder of the puzzle type, which requires the user to solve a puzzle in order to separate the two parts of the key holder. The novelty of combining a puzzle with a two-part key holder is intriguing, and accordingly has definite sales appeal.

It is another object of the present invention to provide a puzzle key holder of the aforedescribed nature which may be inexpensively manufactured from a synthetic plastic, and yet which will provide a long and trouble-free service life.

A further object of the present invention is to provide a puzzle key holder of the aforedescribed nature which is simple in design and of compact size so as to be readily carried in a user's pocket or purse.

It is a more particular object of the present invention to provide a puzzle key holder of the aforedescribed nature utilizing a main body and an auxiliary body having contiguous edges, with such edges being normally retained together by complementary sockets and pins, and with manipulation of such bodies relative to one another effecting sliding and rotational separation of such parts.

These and other objects and advantages of the present invention will become apparent from the following detailed description.

DESCRIPTION OF A PREFERRED EMBODIMENT

Figure 1:
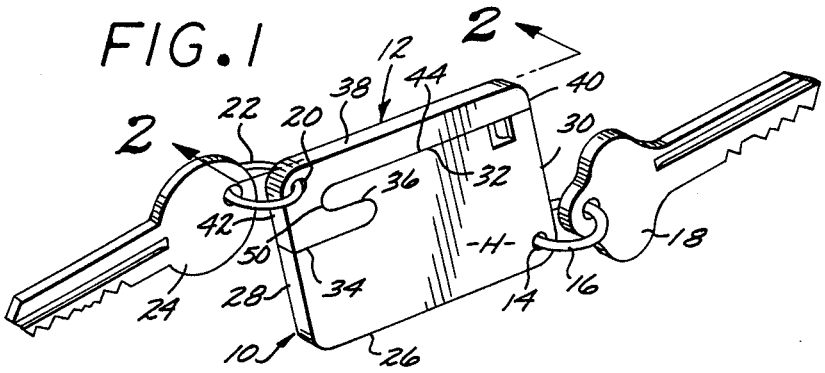
FIG. 1 is a perspective view showing a puzzle key holder embodying the present invention.
Figure 2:
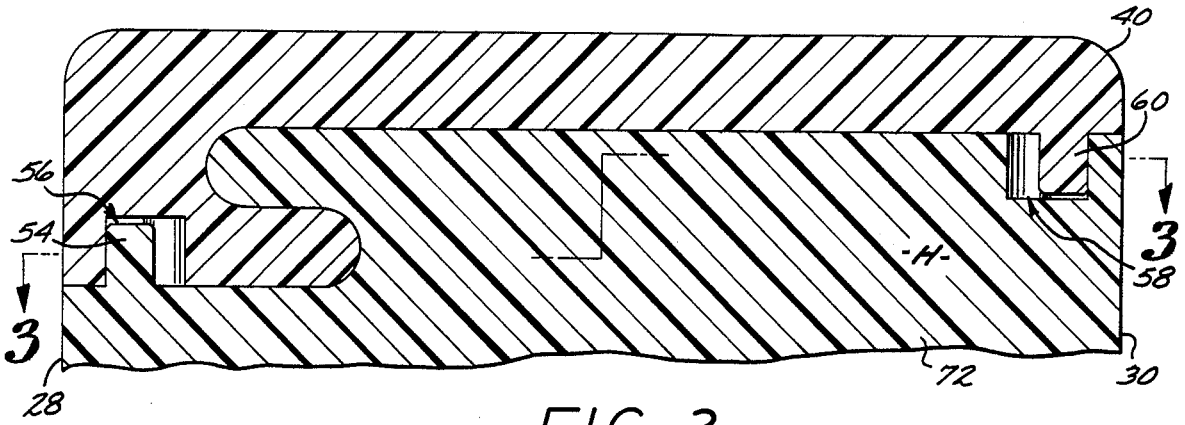
FIG. 2 is a broken vertical sectional view taken in enlarged scale along line 2—2 of FIG. 1.

Referring now to the drawings, a preferred form of puzzle key holder H of the present invention is preferably molded of a hard synthetic plastic. Such key holder, however, could be formed of other materials.

The key holder H includes an integral flat, generally rectangular main body, generally designated 10, and an integral auxiliary body, generally designated 12. Main body 10 is formed at its lower right-hand portion with an opening 14, which receives the key ring 16 of a first key or set of keys 18. The opposite upper left-hand corner of the auxiliary body 12 is formed with an opening 20 which receives a key ring 22 attached to a second key or set of keys 24. It may be assumed that the first key or set of keys 18 are house keys, while the key or set of keys 24 are ignition keys for an automobile. Other key combinations may likewise by employed.

More particularly, the main body 10 has a bottom edge 26, two side edges 28 and 30, and a top edge that includes a long top surface 32, parallel to the bottom edge 26 and extending along the major length of the main body, and a second short top surface 34 parallel with the first top surface 32 and spaced downwardly therefrom. The first and second surfaces 32 and 34 are connected by a generally S-shaped surface 36. The auxiliary body 12 has top edge 38 parallel with the bottom edge 26 of the main body and side edges 40 and 42 contiguous with the side edges 28 and 30 of the main body. The auxiliary body also has a long bottom surface 44 complementary to and normally abutting the long top surface 32 of main body 10 and a short bottom surface 45 complementary to and abutting the short top surface 34 of the main body. Auxillary body 12 is likewise formed with a generally S-shaped surface 50 complementary to and normally abutting the S-shaped surface 36 of the main body.

Figure 3:
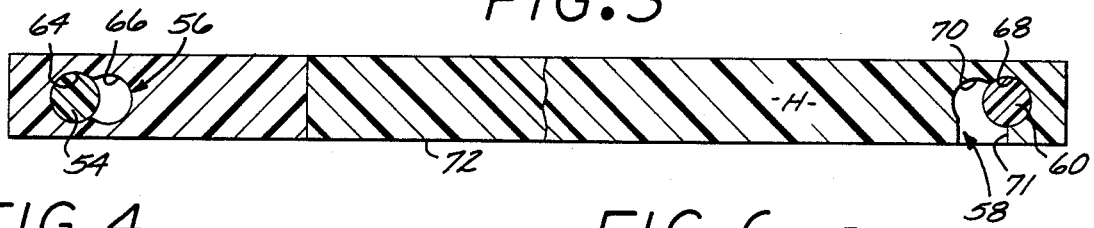
FIG. 3 is a horizontal sectional view taken along line 3—3 of FIG. 2.

The upper left-hand corner of main body 10 is formed adjacent its side edge 28 with an upstanding pin 54, which is complementary to and normally received by a downwardly facing socket generally designated 56, formed in the lower left-hand portion of auxiliary body 12. A similar but upwardly facing socket generally designated 58, is formed in the upper right-hand portion of main body 10 adjacent side edge 30 to normally receive a depending pin 60 formed in the lower right-hand side of auxiliary body 12 adjacent its side edge 40. Referring particularly to FIG. 3, it will be observed that socket 56 includes a first cylindrical portion 64, which normally receives pin 54 and merges at its right-hand portion with an adjoining cylindrical portion 66. Similarly, socket 58 includes a first cylindrical portion 68, which normally receives pin 60 and merges at its left-hand portion with an adjoining cylindrical portion 70. It will also be noted that the front of socket 58 is formed with a forwardly extending tunnel 70 that opens to the front surface 72 of the main body.

Figure 4:
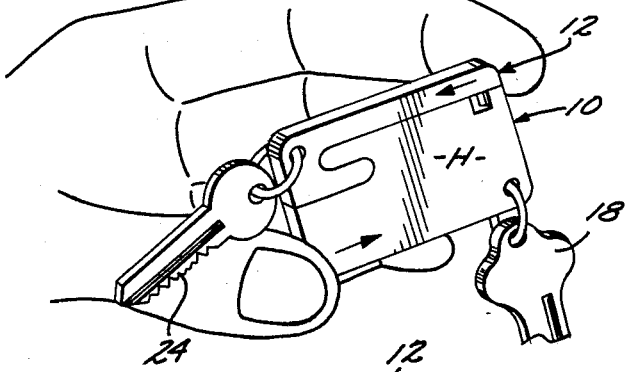
FIGS. 4 through 7 are perspective views showing how the two parts of said puzle key holder are manipulated so as to effect their relative separation.

The operation of the aforedescribed puzzle key ring H is shown in FIGS. 4 through 7. Referring first to FIG. 4, the key holder is shown in its normal assembled condition. In order to separate the main body 10 and the auxiliary body 12, the user grasps the puzzle key holder as shown in this figure. Thus, the user's thumb is placed against the lower left-hand portion of main body 10 with his forefinger placed adjacent the right-hand portion of auxiliary body 12. A squeezing pressure is then applied by means of the user's thumb and forefinger.

Figure 5:
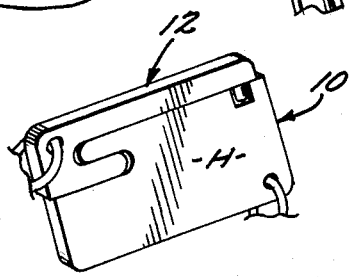

Referring now to FIG. 5, such squeezing pressure causes the main body and auxiliary body to undergo slight longitudinal separation as the auxiliary body moves to the left relative to the main body. During such movement, pins 54 and 60, respectively, enter socket portions 66 and 70.

Figure 6:
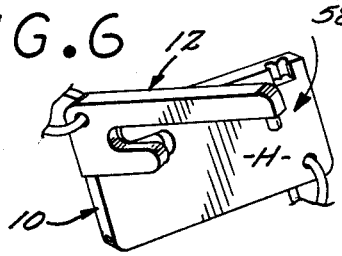
Figure 7:
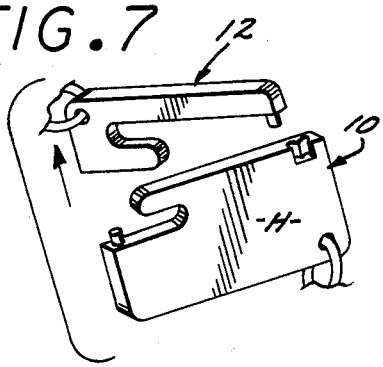

Referring now to FIG. 6, when pin 60 is moved into socket portion 70, such pin can be displaced forwardly through tunnel 71, the auxiliary body rotating about pin 54, which has now entered socket portion 66. The auxiliary body is rotated forwardly relative to the main body until the S-shaped portion 50 of the auxiliary body clears the S-shaped portion 36 of the main body. The auxiliary body may then be raised off pin 54 so as to effect separation of the main body and auxiliary body as shown in FIG. 7. The user can then leave the auxiliary body and its car ignition key 24 in the car's ignition while retaining main body 10 and its house key or keys 18 in his possession.

Although the body-separating operation hereinabove described is simple to accomplish once the user has learned such procedure, the initial solving of such puzzle is intriguing. Accordingly, the puzzle key holder of the present invention has definite sales appeal. Such puzzle key holder is admirably suited for use as an advertising or promotion article. In this regard, the front and/or rear surfaces of such puzzle key holder may be imprinted with an advertising message. Additionally, only the owner of the key holder knows how to solve the puzzle, thereby affording security against unauthorized access to the keys.

While there has been shown and described what is presently considered to be a preferred embodiment of the present invention, it will be apparent that various modifications and changes may be made with respect to the foregoing detailed description without departing from the spirit of the present invention.

We claim:

1. A generally rectangular puzzle key holder for use with two key rings, comprising:

a main body having a bottom edge, two side edges, and a top edge that includes a first surface top parallel with said bottom edge and extending along the major length of the main body, a second top surface parallel with the first top surface and spaced downwardly therefrom, with said first and second surfaces connected by a generally S-shaped surface;

an auxiliary body having a top edge parallel with the bottom edge of the main body, side edges contiguous with the side edges of the main body, a first bottom surface complementary to and normally abutting the first top surface of the main body, a second bottom surface complementary to and normally abutting the second top surface of said main body, and a generally S-shaped surface complementary to and normally abutting the S-shaped surface of said main body;

vertically extending complementary sockets and pins formed in the abutting edge portions of said bodies, said sockets being elongated longitudinally, each of said sockets defining at least a pair of longitudinally displaced compartments in open communication each with respect to the other, each of said compartments normally snugly engaging said pins to retain said bodies together but permitting longitudinal relative movement of one body relative to the other whereby the end of the auxiliary body remote from the S-shaped surface may be rotated away from the main body through an opening formed in a lateral wall of said main body when one of said pins is aligned with said opening to clear the S-shaped surface of said auxiliary body from the S-shaped surface of said main body for separation of the bodies from one another; and, means for holding a key formed on each of the bodies.

2. A puzzle key holder as set forth in claim 1 formed of a synthetic plastic.

3. A puzzle key holder as set forth in claim 1 wherein said sockets each include two adjacent cylindrical portions that permit relative longitudinal movement of said bodies, with one of said sockets being formed with a tunnel that opens to the front surface of one of said bodies permitting the pin normally disposed therein to be displaced through said tunnel as said bodies undergo relative rotation.

4. A puzzle key holder as set forth in claim 3 formed of a synthetic plastic.

* * * * *